US009718638B2

(12) United States Patent
Guiffault et al.

(10) Patent No.: US 9,718,638 B2
(45) Date of Patent: Aug. 1, 2017

(54) FIBER OPTIC REEL STAND WITH AXLE BEARING ASSEMBLY

(71) Applicant: Optical Cable Corporation, Roanoke, VA (US)

(72) Inventors: Nicolas P. Guiffault, Allen, TX (US); Venkata R. Penumatcha, Plano, TX (US)

(73) Assignee: Optical Cable Corporation, Roanoke, VA (US)

( * ) Notice: Subject to any disclaimer, the term of this patent is extended or adjusted under 35 U.S.C. 154(b) by 250 days.

(21) Appl. No.: 14/645,725

(22) Filed: Mar. 12, 2015

(65) Prior Publication Data

US 2015/0259173 A1 Sep. 17, 2015

Related U.S. Application Data

(60) Provisional application No. 61/951,775, filed on Mar. 12, 2014.

(51) Int. Cl.
*B65H 49/32* (2006.01)

(52) U.S. Cl.
CPC ..... *B65H 49/321* (2013.01); *B65H 49/325* (2013.01); *B65H 2701/32* (2013.01)

(58) Field of Classification Search
CPC ..... B65H 49/20; B65H 49/205; B65H 49/32; B65H 49/321; B65H 49/325; B65H 2701/32; B65H 16/06
See application file for complete search history.

(56) References Cited

U.S. PATENT DOCUMENTS 1,819,252 A * 8/1931 Linsner ..... A47B 13/021 144/286.1
2,823,078 A * 2/1958 Keema ..... B25H 1/06 182/151

(Continued)

FOREIGN PATENT DOCUMENTS

CA 2518523 C 9/2006
CN 1325359 C 8/2002

(Continued)

*Primary Examiner* — William E Dondero
(74) *Attorney, Agent, or Firm* — William G. Heedy; David M. Carter; The Van Winkle Law Firm

(57) ABSTRACT

A reel frame stand for supporting a reel thereon comprises a first pair of hingedly connected legs oppositely disposed from a second pair of hingedly connected legs; a first axle bearing on the first pair of legs and a second axle bearing on the second pair of legs, and each of the first and second axle bearings comprising a base and a bushing having a cylindrical inner surface surrounding an open channel; an axle having opposing cylindrical portions being rotatably secured within the open channels of the opposing first and second axle bearings to permit selective rotation of the reel supported thereon; a first brace having one end being rotatably secured to one of the legs of the first pair of legs and a second end being selectively securable at one of a plurality of ports on the first pair of legs by a fastener that is sized and configured for engaged receipt within each of the plurality of ports; a second brace having one end being rotatably secured to one of the legs of the second pair of legs and a second end being selectively securable at one of a plurality of ports on the second pair of legs by a fastener that is sized and configured for engaged receipt within each of the plurality of ports; and wherein each of the first and second pairs of hingedly connected legs may be selectively positioned relative to each other in one of a plurality of configurations (Continued)

including a flat configuration, a closed configuration and an open configuration.

13 Claims, 6 Drawing Sheets

(56) References Cited

U.S. PATENT DOCUMENTS

| | | | | |
|---|---|---|---|---|
| 4,347,992 | A | 9/1982 | Imai | |
| 4,357,519 | A | 11/1982 | Bain, Jr. | |
| 4,467,978 | A | 8/1984 | Farrington | |
| 4,756,385 | A * | 7/1988 | Deitz | B25H 1/06 182/153 |
| 6,086,013 | A * | 7/2000 | Looney, Jr. | B65H 49/321 242/129.5 |
| 6,533,248 | B1 * | 3/2003 | Schafer | B65H 49/32 254/134.3 FT |
| 2009/0074334 | A1 | 3/2009 | Juan | |
| 2016/0101514 | A1 * | 4/2016 | Moore | B25H 1/06 269/309 |

FOREIGN PATENT DOCUMENTS

| | | | |
|---|---|---|---|
| CN | 102996497 | A | 3/2013 |
| GB | 23488 | | 0/1912 |
| GB | 956739 | A | 4/1964 |
| GB | 2453326 | B | 4/2009 |
| JP | 09177853 | A | 7/1997 |
| JP | 4034276 | B2 | 11/2007 |

* cited by examiner

FIBER OPTIC REEL STAND WITH AXLE BEARING ASSEMBLY

BACKGROUND OF THE INVENTION

This application is based on and claims priority to Provisional Patent Application No. 611951,775 filed on Mar. 12, 2014.

FIELD OF THE INVENTION

The invention relates to the field of bearing assemblies used with a longitudinally extending axle, particularly axles for supporting and dispensing fiber optic cables from a portable stand.

DISCUSSION OF THE RELATED ART

Reel stands have been used in the past, of course, and are well known for coiling and uncoiling anything from water hoses to electrical cables. Certain features of this disclosure, therefore, illustrate components of reel stands that have been known previously. Reel stands generally include legged structures that lift a reel so that it is elevated off the ground for dispensing its wound load. Numerous reel stands have hinged legs in a frame that allow for convenient folding and storage. The elevated reel extends across a rotating shaft, or axle, which turns by either the force of the unwinding load or by known crank handles, which may be removable, again for convenient storage. In some prior embodiments of reel stands, the axle may be bifurcated into two coaxial portions so that the same reel stand holds two separate reels controlled by two respective crank handles. Reel stands also include brake mechanisms, such as simple, manually actuated brake handles that press a brake against brake rotors, each engaging respective portions of the reel stand axle, so that the axle portions slow or stop accordingly. Cross supports and gussets allow the reel stands to support reels of desired weight.

Prior art embodiments of reel stands in patent literature include:

CA 2,518,523 (English and Grishaber Nov. 5, 2013)

CN 1,325,359 (Shin, Jungbum Jul. 11, 2007)

WO 0156913 (Shin, Jungbum Aug. 9, 2001)

One important component of reel stands is the bearing used to control the effects of friction, particularly in regard to the above noted rotating shafts. Numerous bearings are known in the prior art, including:

U.S. 20090074334 (Juan 2009)

U.S. Pat. No. 4,347,992 (Imai 1982)

U.S. Pat. No. 4,357,519 (Bain, Jr. 1982)

U.S. Pat. No. 4,467,978 (Farrington 1984)

JP 2003-261040 (Yuzo, Niina Sep. 16, 2003)

JP 9-177853 (Toru, Yoshisaka Jul. 11, 1997)

JP 4034276B2 (Jan. 16, 2008)

GB 23488 (Crawford, May 30, 1912)

GB 2453326 (Teng-Yi, Juan Feb. 15, 2012)

GB 956,739 (Soc. Applicazioni Gomma Antivibranti S.p.A. Apr. 29, 1964)

CN 201210540949 (tang, MeiMei Mar. 27, 2013).

Even in light of the above, there exists a need in the art of reel stands for a reel stand for dispensing fiber optic cabling that offers improved reel function via its rotating axle and other functional aspects.

SUMMARY OF THE INVENTION

The present invention is directed to a reel frame stand for supporting a reel thereon, and the reel frame stand comprising a first pair of hingedly connected legs oppositely disposed from a second pair of hingedly connected legs, and each of the pairs of legs forming a frame; a first axle bearing on the first pair of legs and a second axle bearing on the second pair of legs, and each of the first and second axle bearings comprising a base and a bushing having a cylindrical inner surface surrounding an open channel; an axle having opposing cylindrical portions being rotatably secured within the open channels of the opposing first and second axle bearings to permit selective rotation of the reel supported thereon; a first brace having one end being rotatably secured to one of the legs of the first pair of legs and a second end being selectively securable at one of a plurality of ports on the first pair of legs by a fastener that is sized and configured for engaged receipt within each of the plurality of ports; a second brace having one end being rotatably secured to one of the legs of the second pair of legs and a second end being selectively securable at one of a plurality of ports on the second pair of legs by a fastener that is sized and configured for engaged receipt within each of the plurality of ports; and wherein each of the first and second pairs of hingedly connected legs may be selectively positioned relative to each other in one of a plurality of configurations including a flat configuration, a closed configuration and an open configuration.

BRIEF DESCRIPTION OF THE DRAWINGS

For a fuller understanding of the nature of the present invention, reference should be made to the following detailed description, taken in conjunction with the accompanying drawings in which.

Like reference numerals refer to like parts throughout the several views of the drawings.

DETAILED DESCRIPTION OF THE PREFERRED EMBODIMENTS

Referring to the several views of the drawings, the reel frame stand of the present invention and described herein is shown and is generally indicated as (5).

Figure 1:
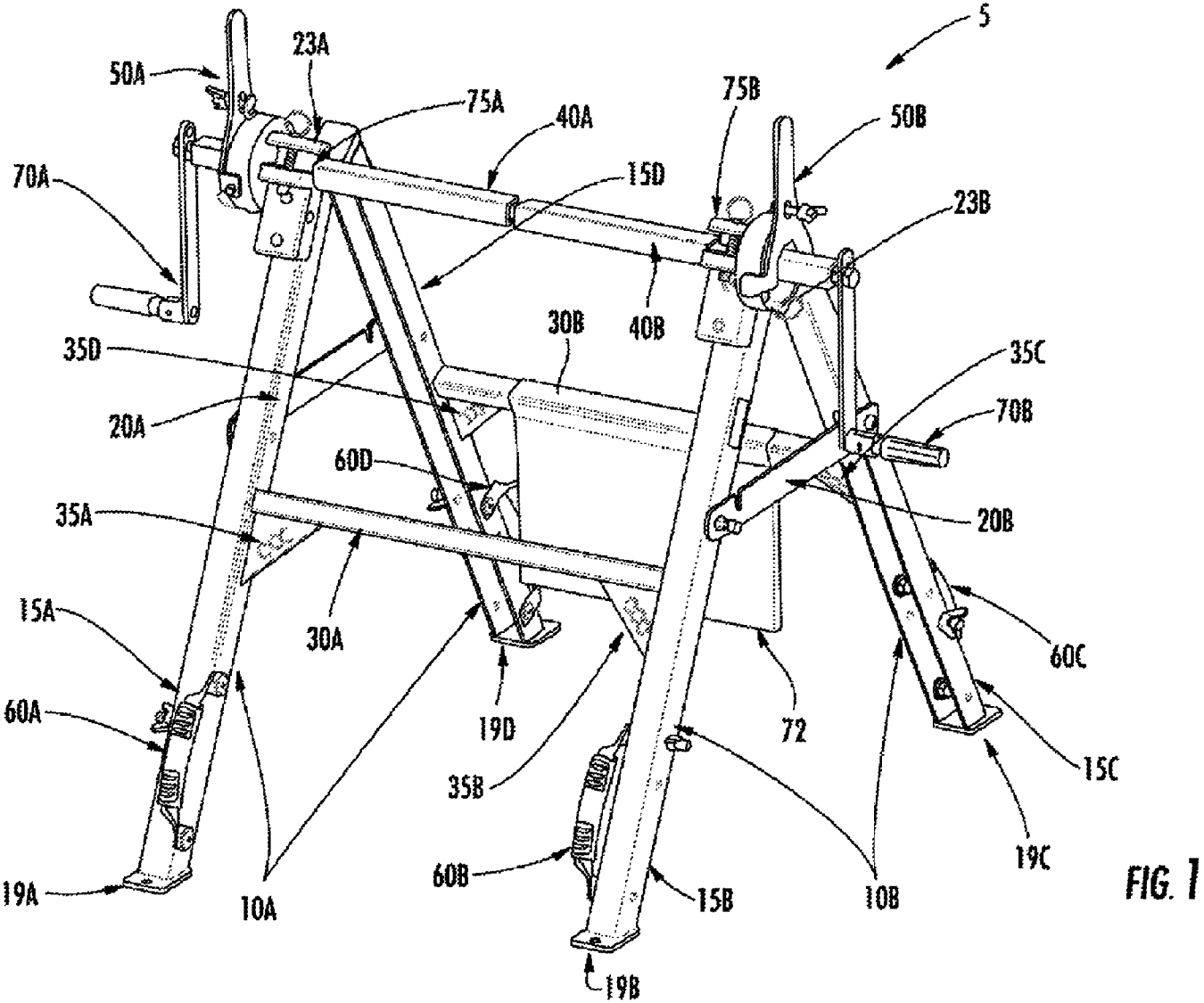
FIG. 1 is a front perspective view of a reel stand with a bearing assembly as disclosed herein.
Figure 3B:
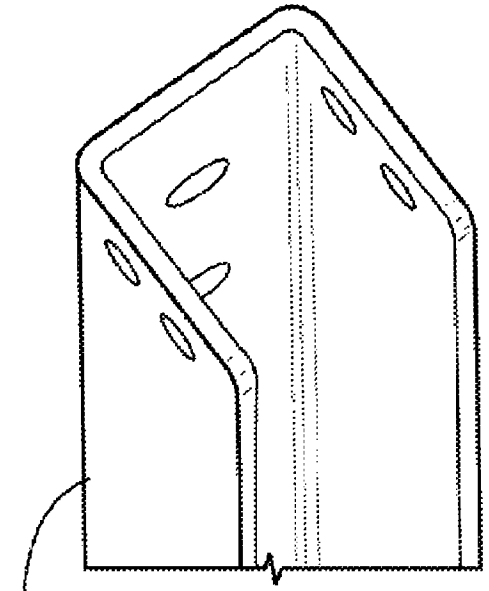
FIG. 3B is a side perspective view of a C-channel structure composing the legs of the reel stand of FIG. 1.
Figure 3A:
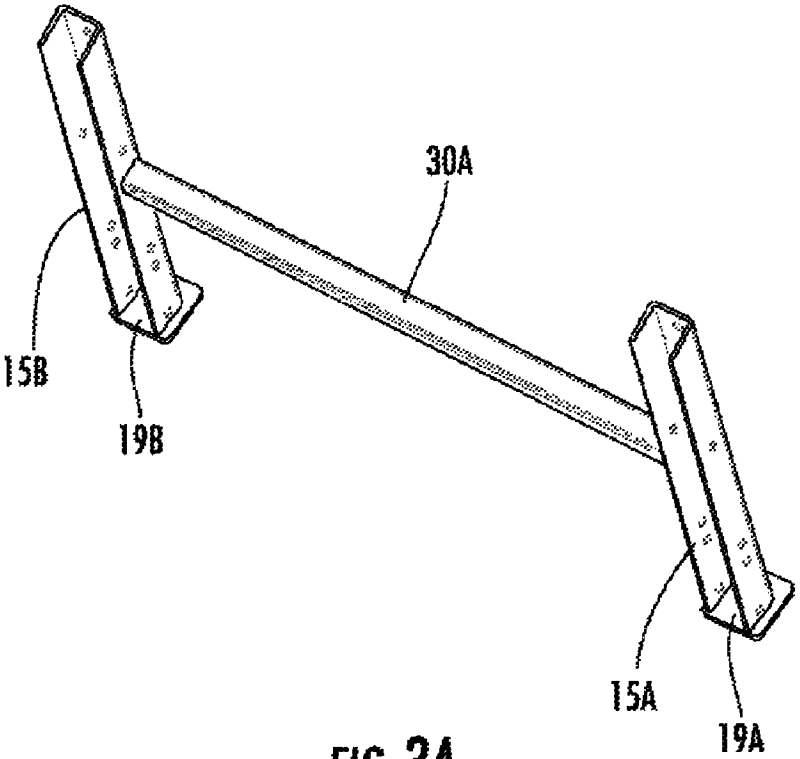
FIG. 3A is an inside view of opposite front legs of reel and connected with a cross support.

Referring initially to FIG. 1, the reel frame stand (5) is shown as including oppositely positioned frames (10A, 10B), with each frame (10A, 10B) having two legs (15A/15D; 15B/15C) connected as hinged pairs, and the hinged pairs of legs are connected to each other by a pair of cross supports (30A, 30B), each extending from opposite legs of opposite frames. Gussets (35A, 35B, 35C, 35D) support the cross supports and attach to both the cross supports (30) and each frame (10). The hinged pairs of legs that make up each frame (10A, 10B) have a respective brace (20A, 20B) stabilizing and positioning the legs of the respective frames (10A, 10B). Footers (19A, 19B, 19C, 19D) stabilize each of the legs. The hinges (23A, 23B) allow the legs (15A, 15B, 15C, 15D) to extend end to end in a fully open position and/or define angles between zero and one hundred eighty degrees (0° and 180°). Footers (19A, 19B, 19C, 19D) stabilize the frames (10A, 10B) on a supporting surface, such as the ground or floor. Each leg (15) has an attached handle (60A, 60B, 60C, 60D), which may be made of numerous kinds of flexible or rigid materials. A pouch (72) is attached to the reel stand (5), most likely along one of the cross supports (30A, 30B), to hold spare parts, useful tools, or other accessories that are helpful in the field for utilizing the reel stand to distribute fiber. FIGS. 3A and 3B show one non-limiting embodiment of the frame (10A, 10B) and cross bar (30A, 30B) construction utilizing C-channel bars with lower weight than solid counterparts, FIG. 1 emphasizes that the reel stand (5) has hinged legs (15A-15D) in a frame (10A, 10B) that allow for convenient folding and storage. An elevated reel extends across a rotating shaft, or axle (40), which turns by either the force of the unwinding load or by crank handles (70A, 70B), which may be selectively removable, again for convenient storage. The reel stand of FIG. 1 incorporates a bifurcated axle (40) with two coaxial portions (40A, 40B) so that the same reel stand can hold one solitary reel of fiber or two separate reels controlled by two respective crank handles (70A, 70B) (i.e., each portion (40A, 40B) of the axle (40) rotates with a distinct speed, independently of the other). Reel stands also include brake mechanisms (50A, 50B), such as simple, manually actuated brake handles that press a brake against brake rotors, each engaging respective portions of the reel stand axle, so that the axle portions slow or stop accordingly.

Figure 2:
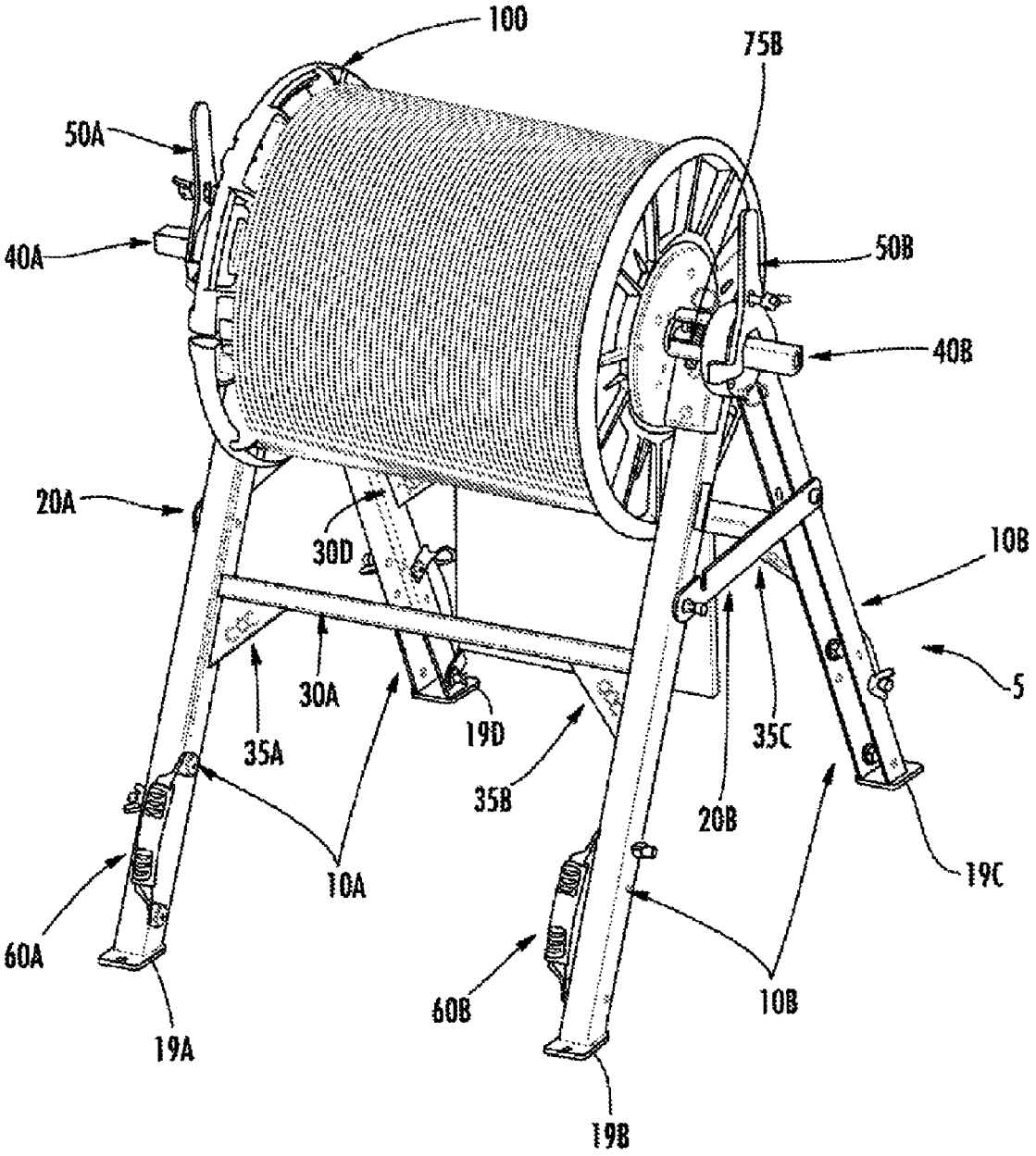
FIG. 2 is a front perspective of a reel stand having a reel installed on an axle as disclosed herein.

FIG. 2 illustrates the reel stand of FIG. 1 with a reel (100) of fiber supported by the axle (40) through the center passage of the reel. Removable crank handles (70A, 70B) allow the user to remove the axle (40) by sliding it through the brake mechanisms (50A, 50B), including the rotor on which the brake handle actuates. In other words, as shown in FIG. 2, the reel (100) fits onto the axle (40) and can be turned along with the axle.

FIGS. 1 and 2 further illustrate the use of axle bearings (75A and 75B) through which the reel stand axle (40) also extends. In the embodiment of FIGS. 1 and 2, which are not limiting of the invention herein, each axle bearing (75A and 75B) attaches to and extends from one of the legs (15) in each frame (10A, 10B). Each axle bearing (75A and 75B) supports the axle (40) so that it clears the mechanics (i.e., the braking mechanism) with less friction.

Figure 4B:
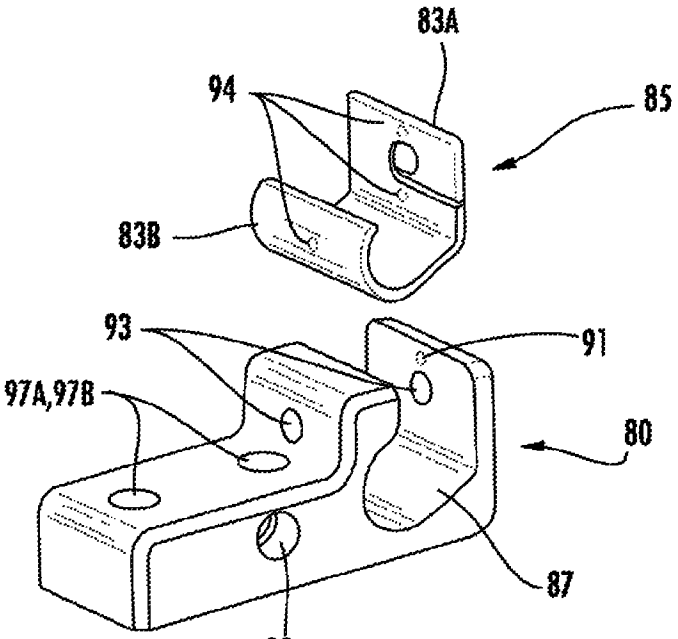
FIG. 4B is an exploded view of the bearing assembly of FIG. 4A.
Figure 4A:
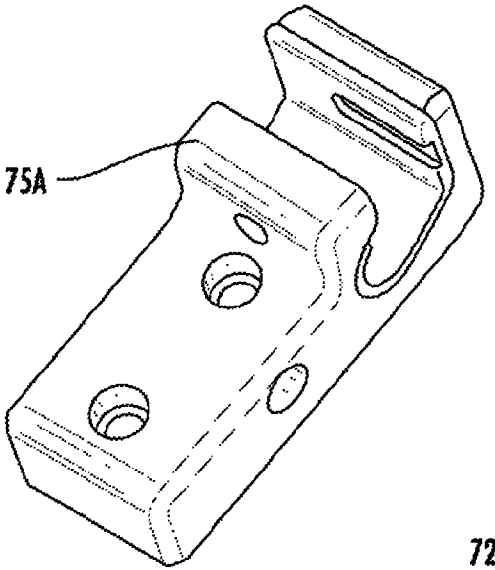
FIG. 4A is a top perspective view of a bearing assembly installed on the reel stand for receiving the axle of the reel stand as disclosed herein.
Figure 4C:
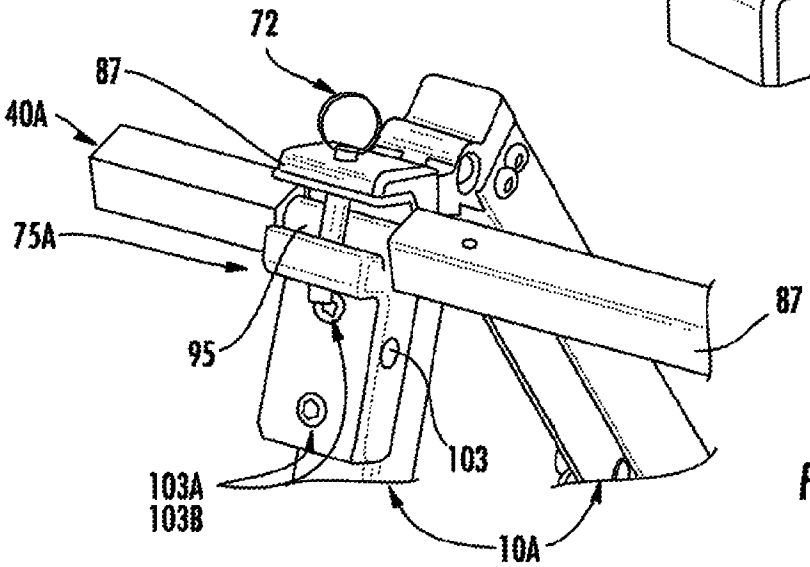
FIG. 4C is a front perspective view of the bearing assembly of FIG. 4A installed on the reel stand of FIG. 1.

FIGS. 4A, 4B, and 4C illustrate details of the bearing construction. FIG. 4A shows the overall bearing assembly (75A) ready for use in conjunction with the reel stand (5), as shown in FIG. 4C. FIG. 4B illustrates that the base (80) of the bearing assembly (75A) defines an internal contour (87) in which the axle rests, as shown in FIG. 4C. A separate and removable bushing (85) has a corresponding shape to the internal contour (87) in that it incorporates a vertical planar region (83A) that bends toward a curved region (83B). The curved region (83B) fits into the internal contour (87) of the base (85) to form a trough in which the axle fits. The bushing incorporates tabs (94) on an outer surface (shown by representation as dotted circles on the inner surface of the bushing). The base (80) has indentions (91) that correspond to the tabs (94) to hold the bushing (85) in place within the base (80).

FIG. 4C illustrates that a bare portion of the axle (40) fits within the defined trough of the bushing (85) within the base (80). Other than the smooth cylindrical region of the axle fitting within the bushing, the axle (40) may have a different shape or diameter so that the axle fits securely within a center opening of the reel and the braking mechanism without slipping therein. In the non-limiting example of FIG. 4C, the axle (40) incorporates a smooth cylindrical bare portion (95) that rotates within the bushing (85) with reduced friction. The remainder of the axle is made, coated, or covered by material having a square cross section that fits within the reel (100) and the braking mechanism (50). Further to FIG. 4C, the base (80) and bushing (85) assembly is secured to one of the legs (15) on the same side of each frame (10A, 10B) by appropriate fasteners (103A, 103B) fitting into corresponding recesses within the base (80). A cross bolt (103) fits into the base via an appropriately sized port (9B) and is provided for increasing structural integrity of the stand (5). A removable pin (72) fits within pin holes (93) to hold the axle (40) within the bushing (85).

FIGS. 5A-5D illustrate how the brace (20) is connected to each frame (10A, 10B) and thereby operates for added functionality of the reel stand (5). As noted above, the hinges (23A, 23B) permit the legs (15A, 15B, 15C, 15D) to be selectively extended end to end in a fully open position and/or define angles between zero and one hundred eighty degrees 0° and 180°).

Figure 5A:
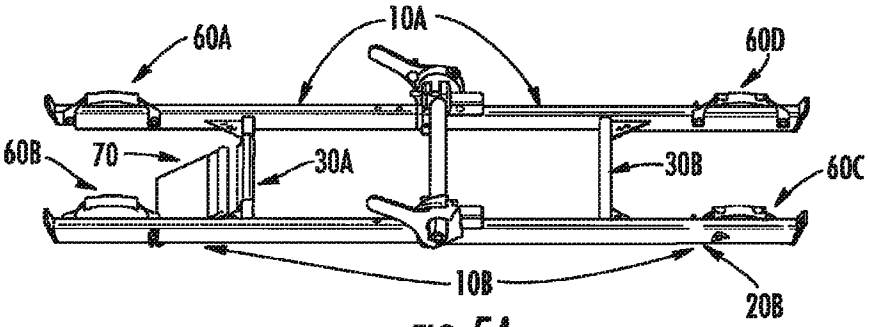
FIG. 5A is a top perspective view of the reel stand of FIG. 1 extended into a flat position for carrying the reel installed on the axle as shown in FIG. 2.
Figure 6A:
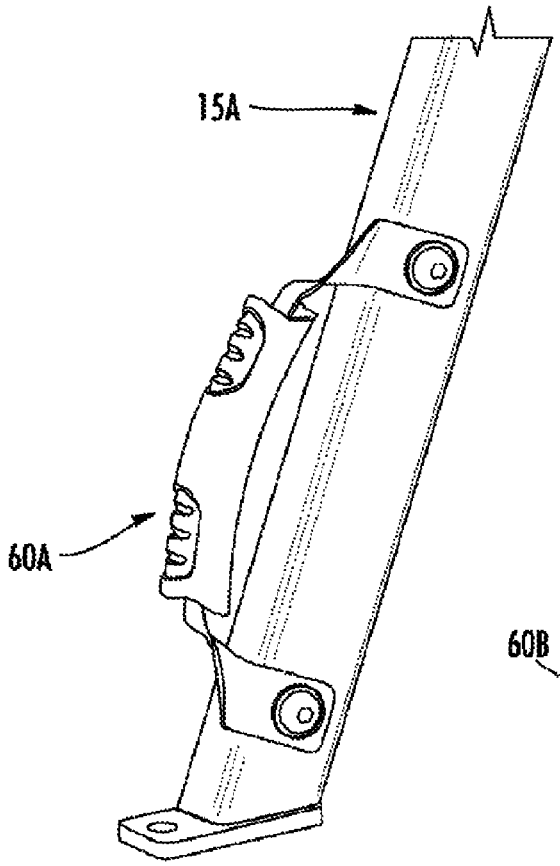
FIG. 6A is a perspective view of a handle attached to a leg of the reel stand of FIG. 1.
Figure 6B:
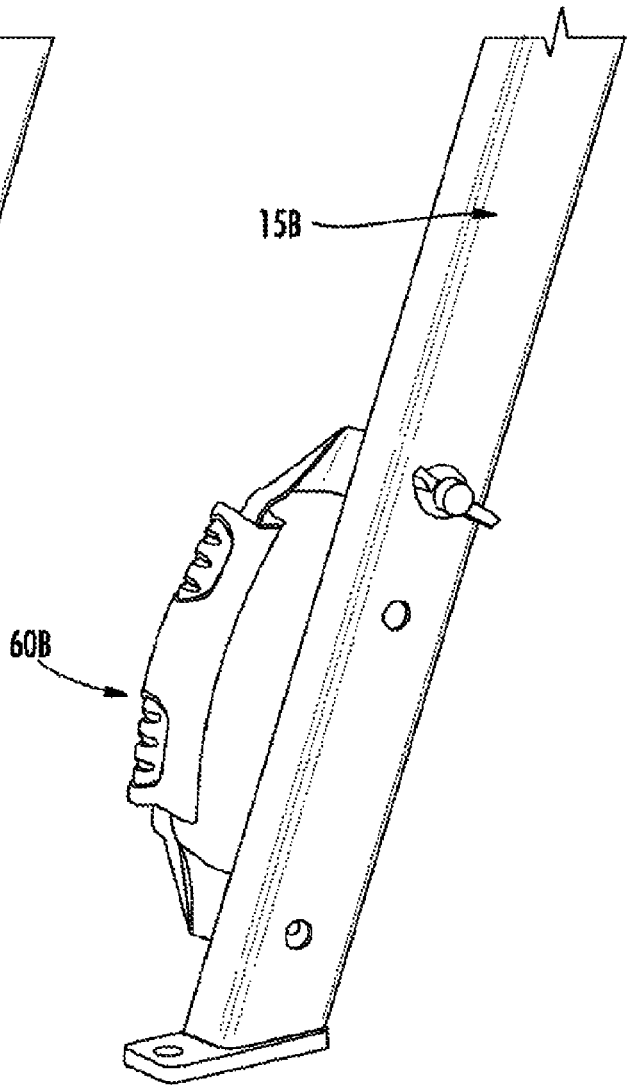
FIG. 6B is a perspective view of second handle attached to a leg of the reel stand of FIG. 1.

Referring specifically to FIG. 5A, the reel stand (5) is shown in the flat position for enabling an assembled reel (5) to be carried with the handles (60A, 60B, 60C, 60D), as more particularly shown in FIGS. 6A and 6B.

Figure 5B:
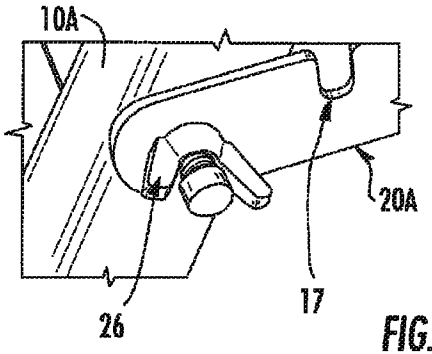
FIG. 5B is a close perspective view of a leg brace that attaches to and detaches from a leg of the reel stand frame via wing nut.
Figure 5C:
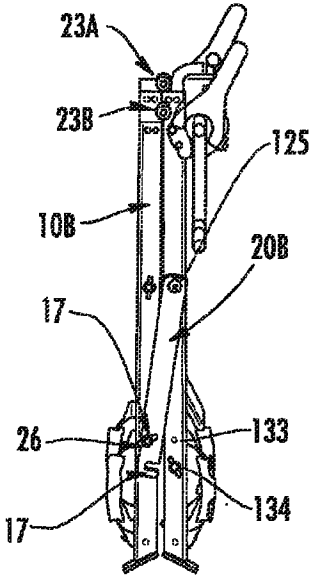
FIG. 5C is a side plan view of the reel stand of FIG. 1 in a folded position.

FIG. 5B specifically illustrates that the brace (20) on each frame (10A, 10B) has different configurations on opposite ends. One end of each brace attaches to one of the legs of the frame in a pivoting configuration so that the brace swings up and down about the pivot point (125). At the opposite end of the brace (20), the brace defines two grooves, referred to herein as frame rests (17) because screw and wing nut fasteners hold each frame (10A, 10B) in a particular configuration by fitting the screw into the groove, or frame rest (17), and tightening the wing nut. As shown up close in FIG. 5B, each brace includes an upper frame rest (17) and a lower frame rest (17) (with screw and wing nut therein). To allow for the reel stand to be flat as in FIG. 5A, folded as shown in FIG. 5C, or open as in FIG. 5D, a removable and replaceable screw and wing nut combination (26) fit into different ports or openings (133, 134) in each leg of the frames so that the frame rests (17) formed within the braces (20) have different places to attach for each of the different frame configurations. Other suitable combinations of connection points between the brace and frame are permissible as well.

As shown particularly in FIG. 5C, each leg (15) defines an opening for a screw and wing nut combination (26) to be the pivot point (125) for the brace (20A, 20B), allowing the brace to swing up and down about the screw and wing nut in an associated leg opening for the pivot point (125). In FIG. 5C, the upper frame rest (17) on the brace (20B)

engages the screw and wing nut combination (26) such that the reel stand (5) stays closed. In the closed position, the screw and wing nut combination (26) are positioned in an intermediate opening (133) (i.e., an opening between the pivot point (125) and the outermost opening (126) for the screw and wing nut). When a reel (100) is installed onto the axle (40), the entire reel (100) and reel stand (5) assembly can be transported by lifting the legs (15A-15D) off the ground and rolling the reel (100) (i.e., similar to pushing a wheel barrow).

Figure 5D:
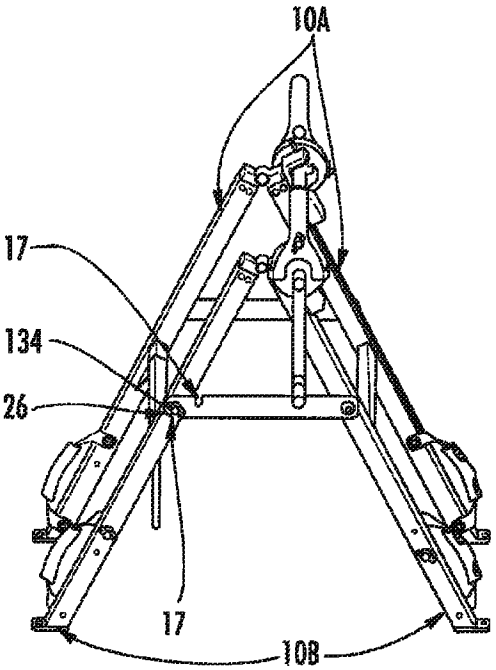
FIG. 5D is a side plan view of the reel stand of FIG. 5C in an open position.

Referring to FIG. 5D, holding the brace (20) and removing the screw and wing nut combination (26), the reel stand (5) can be opened and stabilized by the brace (20). In this configuration, the screw and wing nut combination (26) can be moved to an outermost opening (134) so that a corresponding outermost frame rest (17) on the brace engages the screw and wing nut combination (26) in this outermost position to hold the reel stand open.

Referring to FIGS. 6A and 6B, handles 60A and 60B are shown on legs 15A and 15B, respectively, of the reel stand (5). As previously described, each of the handles 60A-60D may be made from any suitable flexible or rigid materials.

These and other embodiments of the invention described herein are shown in the Figures attached.

While the present invention has been shown and described in accordance with several preferred and practical embodiments, it is recognized that departures from the instant disclosure are contemplated within the spirit and scope of the present invention which are not limited except as defined in the following claims as interpreted by the Doctrine of Equivalents.

What is claimed is:

1. A reel frame stand for supporting a reel thereon, and said reel frame stand comprising:

a first pair of hingedly connected legs oppositely disposed from a second pair of hingedly connected legs, and each of said pairs of legs forming a frame, wherein said first pair of hingedly connected legs comprises a first leg and a second leg and said second pair of hingedly connected legs comprises a third leg and a fourth leg, and wherein said first and third legs are oppositely disposed from each other and said second and fourth legs are oppositely disposed from each other;

a first axle bearing on said first pair of legs and a second axle bearing on said second pair of legs, and each of said first and second axle bearings comprising a base and a bushing having a cylindrical inner surface surrounding an open channel;

an axle having opposing cylindrical portions being rotatably secured within the open channels of said opposing first and second axle bearings to permit selective rotation of the reel supported thereon;

a first brace extending between said first pair of legs and a second brace extending between said second pair of legs, said first brace having a first end that is pivotally secured to said first leg, said second brace having a first end that is pivotally secured to said fourth leg, and each of said first and second braces having a second end defining upper and lower frame rests each being sized and configured for passage therethrough of one of a plurality of screws for selective attachment of the second end of said first and second braces;

said first and fourth legs each having a port that is sized for engaged receipt of one of said plurality of screws and wherein the port on said first leg is correspondingly aligned with the port on said fourth leg;

said second and third legs each having a top port and a bottom port, each of said top and bottom ports being sized for engaged receipt of one of said plurality of screws, and wherein the top and bottom ports on said second leg are each correspondingly aligned with the top and bottom ports on said third leg; and wherein each of said first and second pairs of hingedly connected legs may be selectively positioned relative to each other in one of a plurality of configurations by selectively securing the respective second ends of each of said first and second braces to a respective leg by engaging one of said plurality of screws through one of said upper and lower frame rests at the correspondingly aligned port on said first and fourth legs or at one of the correspondingly aligned top and bottom ports on said second and fourth legs so that said first and second braces are held in engaged abutment with the corresponding leg.

2. The reel frame stand as recited in claim 1 wherein one of the plurality of configurations is an open position wherein the second end of said first brace is secured to the top port on said second leg and the second end of said second brace is secured to the top port on said third leg.

3. The reel frame as recited in claim 1 wherein one of the plurality of configurations is a closed position wherein the second end of said first brace is secured to the bottom port on said second leg and the second end of said second brace is secured to the bottom port on said third leg.

4. The reel frame as recited in claim 1 wherein one of the plurality of configurations is a flat position wherein the second end of said first brace is secured to the port on said first leg and the second end of said second brace is secured to the port on said fourth leg.

5. The reel frame as recited in claim 4 further comprising at least one handle on each of said first, second, third and fourth legs, said handles being configured for grasping by a user when said first and second pairs of hingedly connected legs are in the flat position for transporting said reel frame.

6. A reel frame stand for supporting a reel thereon, and said reel frame stand comprising:

a first pair of hingedly connected legs oppositely disposed from a second pair of hingedly connected legs, and each of said pairs of legs forming a frame, wherein said first pair of hingedly connected legs comprises a first leg and a second leg and said second pair of hingedly connected legs comprises a third leg and a fourth leg, and wherein said first and third legs are oppositely disposed from each other and said second and fourth legs are oppositely disposed from each other;

a plurality of ports on said first and second pairs of hingedly connected legs;

a first axle bearing on said first pair of legs and a second axle bearing on said second pair of legs, and each of said first and second axle bearings comprising a base and a bushing having a cylindrical inner surface surrounding an open channel;

an axle having opposing cylindrical portions being rotatably secured within the open channels of said opposing first and second axle bearings to permit selective rotation of the reel supported thereon using oppositely disposed crank handles in connection therewith;

said axle having a non-circular cross-section central to said opposing cylindrical portions;

a first brace having one end being rotatably secured to the first leg of said first pair of legs and a second end being selectively securable at one of said plurality of ports on said first pair of legs by a fastener that is sized and configured for engaged receipt within each of said plurality of ports;

a second brace having one end being rotatably secured to the fourth leg of said second pair of legs and a second end being selectively securable at one of said plurality of ports on said second pair of legs by a fastener that is sized and configured for engaged receipt within each of said plurality of ports; and wherein each of said first and second pairs of hingedly connected legs may be selectively positioned relative to each other in one of a plurality of configurations by securing the second ends of each of said first and second braces to a corresponding one of said plurality of ports.

7. The reel frame stand as recited in claim 6 wherein said fastener comprises:

a screw having a threaded outer surface, and said screw being sized and configured for engaged receipt within one of said plurality of ports;

a wing nut having a threaded inner surface defining a passage, and said threaded inner surface being sized and configured for threaded fit around said screw; and wherein threaded advancement of said wing nut along screw serves to secure the second end of said first or second brace to one of said plurality of ports.

8. The reel frame stand as recited in claim 6 wherein said bushing is replaceable.

9. The reel frame as recited in claim 6 wherein one of the plurality of configurations is a closed configuration wherein the second end of said first brace is secured to the bottom port on said second leg and the second end of said second brace is secured to the bottom port on said third leg.

10. The reel frame stand as recited in claim 6 wherein one of the plurality of configurations is a flat configuration wherein the second end of said first brace is secured to the port on said first leg and the second end of said second brace is secured to the port on said fourth leg.

11. The reel frame stand as recited in claim 6 wherein one of the plurality of configurations is an open configuration wherein the second end of said first brace is secured to the top port on said second leg and the second end of said second brace is secured to the top port on said third leg.

12. The reel frame stand as recited in claim 6 wherein said axle is bifurcated and wherein each of said bifurcated axles is selectively rotatable using a corresponding one of said oppositely disposed crank handles.

13. The reel frame stand as recited in claim 6 further comprising at least one brake handle, and wherein actuating said brake handle causes a respective brake rotor to engage said axle in order to slow or stop rotation of said axle.

* * * * *